US007891120B1

(12) United States Patent
Neihoff

(10) Patent No.: US 7,891,120 B1
(45) Date of Patent: Feb. 22, 2011

(54) COVER FOR A SHOE TONGUE

(76) Inventor: Randy Neihoff, 223 Logan's Cir., Franklin, TN (US) 37067

( * ) Notice: Subject to any disclaimer, the term of this patent is extended or adjusted under 35 U.S.C. 154(b) by 881 days.

(21) Appl. No.: 11/776,898

(22) Filed: Jul. 12, 2007

(51) Int. Cl.
*A43B 23/26* (2006.01)
*A43B 23/00* (2006.01)

(52) U.S. Cl. ..... 36/136; 36/54

(58) Field of Classification Search ..... 36/136, 36/54, 100
See application file for complete search history.

(56) References Cited

U.S. PATENT DOCUMENTS 2,022,554 A * 11/1935 Williams ..... 36/54
5,265,353 A 11/1993 Marega et al.
5,516,264 A 5/1996 Anetrini
5,566,477 A 10/1996 Mathis et al.
5,659,979 A * 8/1997 Sileo ..... 36/54
5,673,499 A 10/1997 Attilieni
5,701,688 A 12/1997 Crowley
6,397,497 B1 * 6/2002 McAtee ..... 36/54
6,408,542 B1 * 6/2002 Shepherd ..... 36/54
6,988,298 B2 * 1/2006 Ternasky et al. ..... 24/712.3
7,000,337 B2 * 2/2006 Harrington ..... 36/132
7,117,616 B2 * 10/2006 Hull ..... 36/136
7,404,242 B1 * 7/2008 Perler ..... 24/712.2
7,444,724 B1 * 11/2008 Perler ..... 24/712.3
2002/0029494 A1 * 3/2002 Small ..... 36/54
2002/0053147 A1 * 5/2002 Borsoi et al. ..... 36/54

* cited by examiner

*Primary Examiner*—Marie Patterson
(74) *Attorney, Agent, or Firm*—Waddey & Patterson PC; I. C. Waddey, Jr.

(57) ABSTRACT

A shoe cover is inserted over a shoe tongue to protect the shoe tongue and to display advertisements or other fashionable designs. The cover has a sleeve with a fastener attached to an interior surface. A complementary fastener is attached to the shoe tongue. Both fasteners engage to secure the shoe tongue cover onto the shoe tongue.

17 Claims, 2 Drawing Sheets

COVER FOR A SHOE TONGUE

BACKGROUND OF THE INVENTION

The present invention relates generally to a device for protecting the surface of a shoe tongue. More particularly, the device is capable of protecting the shoe tongue while displaying artistic designs, logos, and trademarks.

In today's market, shoes have become items of fashion and style. Thus, it is desirable to protect the surfaces on shoes from dirt and other contaminants. Unfortunately, prior art shoe tongue protection devices are often unnecessarily inflexible in their ability to adjust to different types of shoes and difficult to secure to the shoe tongue.

For example, U.S. Pat. No. 6,397,497 discloses a shoe tongue cover for a shoe tongue. The shoe tongue cover has a body which defines a recess for receiving the shoe tongue. At the bottom of the body, a strip of hook and loop fasteners are attached to an exterior surface. Also at the bottom of the body is a pair of folding ends with a pair of complementary hook and loop fasteners. When the shoe tongue is inserted into the body, the ends are wrapped around the strip of hook and loop fasteners on the external surface of the body. As can be seen, the disclosed shoe tongue cover in this patent cannot be adjusted to different shoe sizes. Furthermore, once the shoe tongue is inserted into the body, the bottom of the cover is within the shoe itself. This makes it difficult to wrap the folding ends onto the strip at the bottom of the body.

BRIEF SUMMARY OF THE INVENTION

What is needed is a shoe cover that is easily secured to the shoe tongue and is easily adjustable to different shoe sizes. In one embodiment of the invention, a sleeve is provided which defines a recess for receiving the shoe tongue. The shoe tongue is received in the sleeve through an opening at the end of the recess. In order to secure the sleeve to the shoe tongue, a sleeve fastener is attached to an interior surface within the sleeve. A complementary shoe fastener is placed on the shoe tongue to engage the sleeve fastener when the shoe tongue is inserted in the sleeve. The recess is adjustable to different types of shoes because a surface on the shoe tongue is marked with measurement markings that indicate shoe tongue lengths for different types of shoes.

Accordingly, one object of the present invention is to provide a shoe tongue cover for a shoe.

Yet another object of the present invention is to provide a shoe tongue cover which is easily secured to the shoe tongue.

Still another object of the present invention is to provide measurement markings for adjusting the recess length of the shoe tongue cover.

DETAILED DESCRIPTION OF THE INVENTION

Figure 1:
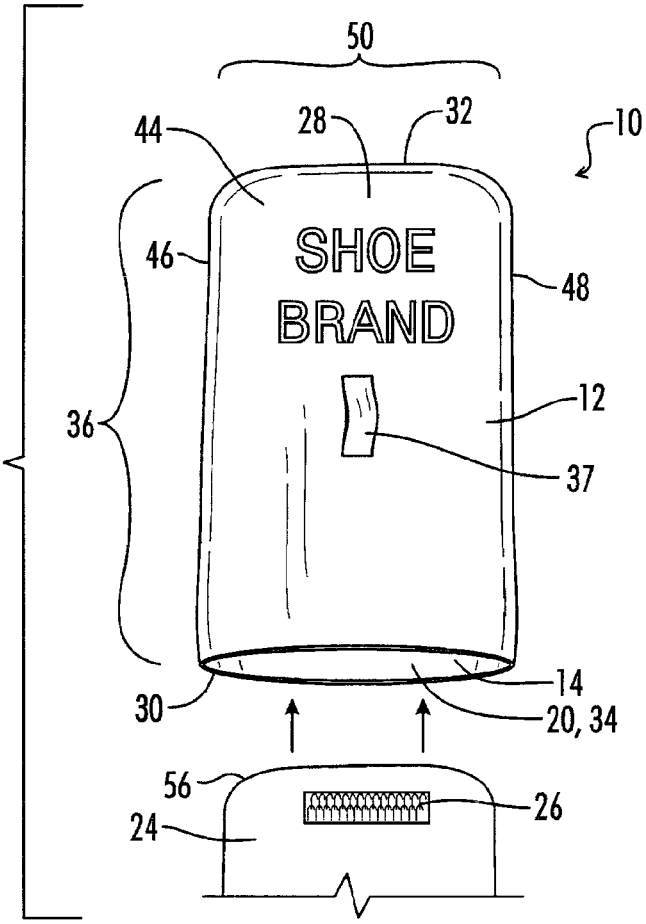
FIG. 1 is a front view of a first embodiment of the device shoe tongue cover and a shoe tongue.
Figure 2:
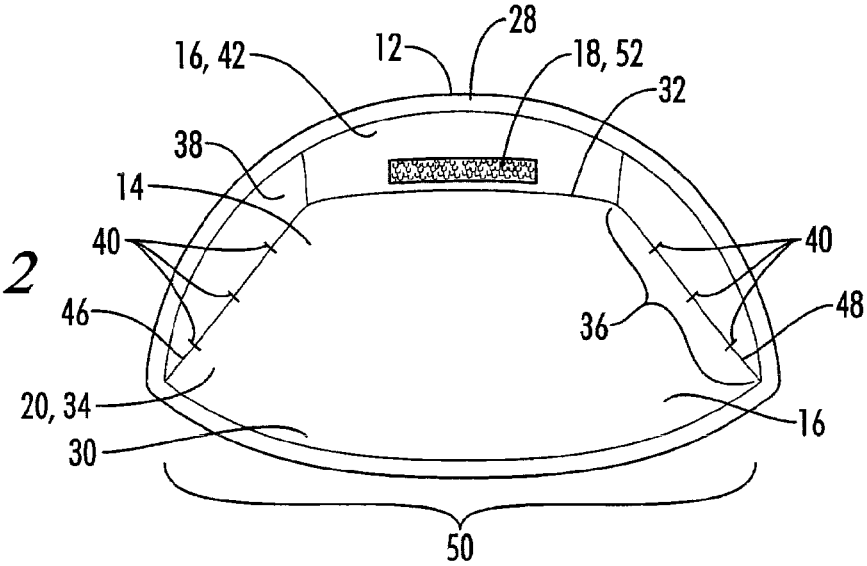
FIG. 2 is an end view of the inside of the shoe tongue cover shown in FIG. 1.

Referring now to FIGS. 1 and 2, a device 10 for covering a shoe tongue on a shoe is shown. In this embodiment, the device has a sleeve 12 defining a recess 14 for receiving the shoe tongue. The sleeve 12 may be of any shape or design so long as the shoe tongue on the shoe is receivable into the recess 14. Manufacturers and shoe companies may thus design sleeves in a variety of functional or aesthetic shapes and configurations to bolster a desired promotional image for the sleeve or shoe.

Figure 3:
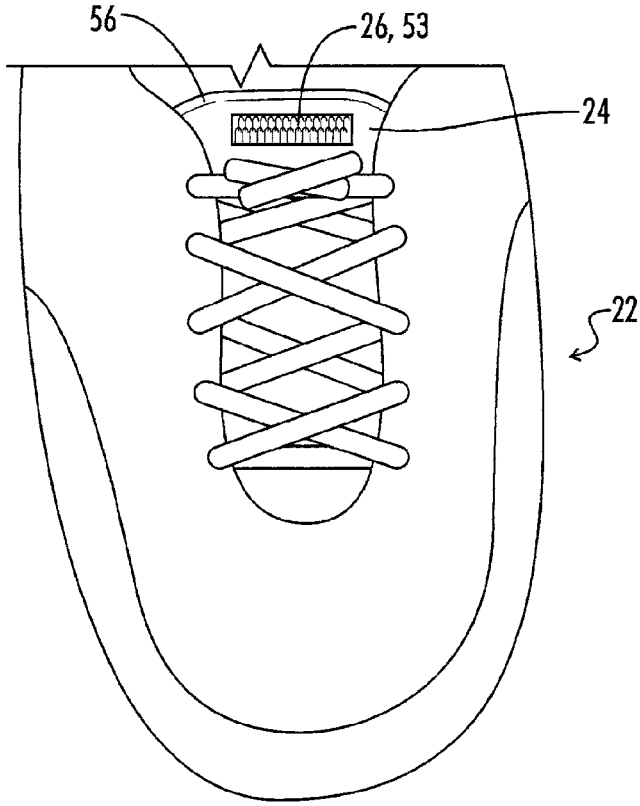
FIG. 3 is a front view of a shoe with a shoe tongue fastener on the shoe tongue for attachment to the sleeve fastener on the shoe tongue cover of FIG. 1.

In order to secure the sleeve 12 to the shoe, a sleeve fastener 18 is attached to an interior surface 16 of the sleeve 12 which borders the recess 14. The shoe tongue is inserted into the recess 14 through an opening 20 at an open end 34 of the recess 14. Referring now to FIGS. 1 and 3, a shoe tongue fastener 26 is attached to a shoe tongue 24 on a shoe 22. When the sleeve 12 is slipped over the shoe tongue 24, the sleeve fastener 18 shown in FIG. 2 and the shoe tongue fastener 26 shown in FIG. 1 and FIG. 3 engage and secure the device 10 on the shoe 22.

The fasteners in this invention may be of any suitable type so long as the fastening mechanism is capable of preventing the sleeve 12 from coming off the shoe 22. Thus, buttons, detachable adhesives, or clipping mechanisms can be utilized; however, in the preferred embodiment the fasteners are strips of hook and loop fasteners, 52, 53 which are shown in FIGS. 1, 2 and 3. As is shown, a first mating portion of a hook and loop fastener 53 is attached to the shoe 22. The second mating portion of the hook and loop fastener 52 is attached to the interior surface 16 of the sleeve 12. As is known in the art, this hook and loop fastener, mating portions 52, 53, are complimentary pieces which are removably attached when engaged to one another.

Figure 4:
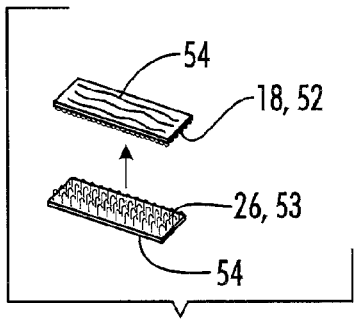
FIG. 4 is a top perspective view of the sleeve fastener and the shoe tongue fastener shown in FIG. 2 and FIG. 3.

Referring now to FIG. 4, the strips 52, 53 of hook and fastener material are shown. These strips may be sewn, zippered or clipped to the interior surface 16 and the shoe tongue. However, in the preferred embodiment the strips 52, 53 are attached to the respective surfaces with an adhesive 54. Referring specifically to FIG. 2, the strip 52 is attached longitudinally across the interior surface 16 of the sleeve 12. Furthermore, in the preferred embodiment the strip 52 is attached adjacent to the first end 32. In this manner, the shoe tongue must be fully inserted into the recess 14 in order for the strip 53 on the shoe tongue to engage the strip 52 on the sleeve 12. As is shown in FIG. 1 and in FIG. 3, the strip 53 is placed at the top end 56 of the shoe tongue. By placing the strip 52 adjacent to the first end and the end of strip 26 adjacent to the top end, the strips 52 and 53 are not inadvertently engaged until the shoe tongue is fully received in the recess 14. This allows the device 10 to be slipped over the shoe tongue without being inadvertently caught before full insertion into the recess 14.

Referring again to FIGS. 1 and 2, the sleeve 12 may be made of a front portion 28 for covering the front side of the shoe tongue and a back portion 30 for covering the back side of the shoe tongue. The front portion 28 may be attached to the back portion 30 to define the recess 14. The recess 14 may have a first end 32 and an open end 34 for inserting the shoe tongue 24 into the recess 14. These opposing ends 32 and 34 define a recess length 36.

Next, the front portion 28 has an interior surface 42 bordering the recess 14 and an exterior surface 44 opposing the interior surface 42. In the preferred embodiment, the interior surface 42 is the markable surface 38 with the measurement markings 40. Also, the exterior surface 44 is normally a printable surface for printing advertising thereon. In this manner, different artistic designs, logos and trademarks may be displayed on the exterior surface 44 when the device 10 is covering the shoe tongue.

Referring again to FIGS. 1 and 2, the sleeve 12 can be dimensioned to fit all different types of shoes. In one embodiment of the invention, the sleeve 12 is manufactured so that the original recess length 36 of the sleeve is capable of fitting the longest shoe tongue known in the industry. In order to adjust the recess length 36 to the length of the shoe tongue for the desired shoe, a markable surface 38 on one of the portions 28, 30 is marked with measurement markings 40. In the preferred embodiment, these measurement markings 40 will be placed at certain locations between the first end 32 and the open end 34 so that the recess 14 can fit a shoe tongue on a man's, a woman's, or a child's shoe. As is known in the art, shoes come with shoe tongues of standard lengths and widths for men, women and children's shoes. By providing these measurement markings 40 a user can adjust the length 36 of the sleeve 12 to fit the desired shoe. The user may cut the sleeve 12 to the desired length or simply fold the open end 34 until the sleeve reaches the desired length.

Another variable in the manufacturing of shoe tongues is the width of the shoe tongue. Different widths are used for a child's, a man's, and woman's shoes. Thus, the sleeve 12 may be manufactured to specifically fit any of these shoe sizes. In the embodiment shown in FIG. 2, the recess 14 has lateral edges 46 and 48 between the first end 32 and the open end 34. These opposed lateral edges 32 and 34 define a recess width 50. This recess width 50 may be of several different sizes depending on the type of shoe for the shoe cover. For example, the recess width 50 may be approximately two and half inches ($2^{1/2}$") to fit a shoe tongue on a child's shoe. Alternatively, the recess width 50 may be approximately three inches (3") to fit a shoe tongue for a woman's shoe. Also, the recess width 50 may be approximately four inches (4") to fit a man's shoe.

Figure 5:
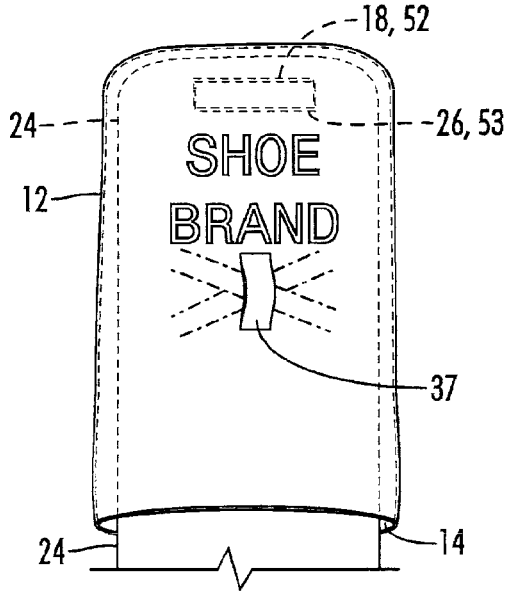
FIG. 5 is a front view of the shoe tongue cover of FIG. 1 inserted over the shoe tongue.

Finally, as shown in FIG. 5, the sleeve 12 may define a loop 37 for securing the sleeve to the tongue. The loop 37 is defined on the exterior surface of the sleeve 12. This loop 37 may be sewn on the exterior surface. However, in the preferred embodiment, the loop 37 is created by cutting a pair of slits on the exterior surface of the sleeve 12. The laces on the shoe may be inserted through this loop 37 so that the sleeve is secured to the shoe.

Thus, although there have been described particular embodiments of the present invention of a new and useful Cover for Slip Tongue, it is not intended that such references be construed as limitations upon the scope of this invention except as set forth in the following claims.

What is claimed is:

1. A device for covering a shoe tongue on a shoe wherein the shoe tongue has a front side and a back side, the device comprising:

a front portion for covering the front side of the shoe tongue, said front portion being elongated with opposing sides and opposing ends;

a back portion for covering the back side of the shoe tongue wherein the front portion is attached to the back portion along said sides and one of said opposing ends to define a recess having a recess width for receiving the shoe tongue, the recess having a first enclosed end and an opposing open end for inserting the shoe tongue into the recess wherein the first end is opposite the open end to define a recess length; and a markable surface on one of the portions, the surface having measurement markings between the first end and the open end for adjusting the recess length of the recess.

2. The device of claim 1, wherein the back portion comprises an expandable material for enlarging the recess.

3. The device of claim 1, wherein the front portion comprises the markable surface having the measurement markings.

4. The device of claim 1, wherein the front portion further comprises an interior surface bordering the recess and an exterior surface opposing the interior surface and the interior surface comprises the markable surface having the measurement markings.

5. The device of claim 4, wherein the exterior surface comprises a printable surface for printing advertising thereon.

6. The device of claim 1, wherein the recess width is approximately $2^{1/2}$" inches.

7. The device of claim 1, wherein the recess width is approximately 3" inches.

8. The device of claim 1, wherein the recess width is approximately 4" inches.

9. A device for covering a shoe tongue that is elongated with a proximal end attached to a shoe and a distal, free end and an middle section between the proximal end and the distal, free end, the device comprising:

An elongated sleeve generally in the shape of a shoe tongue having opposing sides and opposing ends and being substantially closed on said opposing sides and at one of said opposing ends defining a recess for receiving a shoe tongue;

A shoe tongue fastener for attachment to the distal, free end of a shoe tongue, and a sleeve fastener attached to the interior surface of the sleeve adjacent said closed end whereby said sleeve fastener is positioned to engages said shoe tongue fastener when said shoe tongue fastener has been attached to the distal, free end of a shoe tongue to secure the sleeve to a shoe tongue when a shoe tongue to which said shoe tongue fastener has been attached at the intended position is received in the recess.

10. The device of claim 9, wherein the sleeve fastener further comprises a strip of a hook and fastener material.

11. The device of claim 10, wherein the strip is attached longitudinally across the interior surface of the sleeve.

12. The device of claim 11, wherein the strip is attached to the interior surface with an adhesive.

13. The device of claim 9, further comprising the recess having a closed end opposite the opening wherein the sleeve fastener is attached adjacent to the closed end.

14. The device of claim 9, wherein the material that forms said recess is expandable.

15. An item of footwear, comprising:

a shoe having a shoe tongue;

a shoe tongue fastener attached to the shoe tongue;

a sleeve, said sleeve being elongated with a top, bottom, and opposing sides and substantially enclosed on said top and sides with and open bottom, creating a recess defining an opening and an interior surface bordering the recess wherein the shoe tongue is inserted through the opening and is received in the recess; and a sleeve fastener attached to the interior surface of the sleeve at the top of said sleeve such that the shoe tongue fastener engages the sleeve fastener to secure the sleeve to the shoe tongue.

16. The item of footwear of claim 15, further comprising:

the shoe fastener comprises a first mating portion of a hook and loop fastener; and the sleeve fastener comprising a second mating portion of a hook and loop fastener complementary to the first mating portion wherein the mating portions are engaged to secure the shoe tongue to the sleeve.

17. The item of footwear of claim 16 further comprising:

the shoe tongue having a top end wherein the first mating portion is attached adjacent to the top end; and the sleeve having a closed end opposite the opening wherein the sleeve fastener is attached adjacent to the closed end.

* * * * *